United States Patent [19]

O'Neill

[11] Patent Number: 4,508,219

[45] Date of Patent: Apr. 2, 1985

[54] SECURITY SAFETY CRADLE

[76] Inventor: Hector C. O'Neill, 9900 Jovita Ave., Chatsworth, Calif. 91311

[21] Appl. No.: 502,557

[22] Filed: Jun. 9, 1983

[51] Int. Cl.[3] ..... B65D 85/68

[52] U.S. Cl. ..... 206/319; 410/2; 248/640; 248/641; 248/643

[58] Field of Search ..... 206/317, 319, 386, 600; 248/640, 641, 642, 643; 410/2, 31, 32, 33, 42, 46, 47, 48, 120; 211/96, 168

[56] References Cited

U.S. PATENT DOCUMENTS

| | | | |
|---|---|---|---|
| 2,231,277 | 2/1941 | Mepham | 248/643 |
| 2,515,428 | 7/1950 | Scott et al. | 206/319 |
| 2,575,749 | 11/1951 | Cross | 206/319 |
| 2,613,896 | 10/1952 | Witt | 248/643 |
| 2,686,028 | 8/1954 | Johnson | 206/319 |
| 2,745,673 | 5/1955 | Koepke et al. | 410/2 |
| 2,822,142 | 2/1958 | Collins | 248/641 |
| 3,601,251 | 8/1971 | Schwaner | 206/319 |
| 3,874,318 | 4/1975 | Langley | 248/642 |
| 4,175,666 | 11/1979 | Smith | 410/42 |
| 4,331,431 | 5/1982 | Estes | 248/640 |
| 4,355,986 | 10/1982 | Stevens | 248/640 |

FOREIGN PATENT DOCUMENTS

| | | | |
|---|---|---|---|
| 590693 | 1/1960 | Canada | 248/643 |

*Primary Examiner*—Joseph Man-Fu Moy

*Assistant Examiner*—David T. Fidei

*Attorney, Agent, or Firm*—Donald E. Nist

[57] ABSTRACT

The safety cradle is adapted to releasably secure an outboard motor for storage and transport and is particularly adapted for mounting in the cargo portion of an open or paneled truck. The cradle includes an upright transverse pivot brace securable at one end thereof to a support structure such as the truck sidewall, with a pair of pivot points at its opposite free end, and an elongated support arm having a motor supporting portion. The arm is pivotally secured to the brace at the pivot points and is rotatable between a forward secured position and a rearward release position. A bracket is also provided which is securable to the flat bed of the truck in front of the pivot brace at a location to engage the free end of the pivot arm. The bracket includes a base and an upright bearing a transverse lock bar and a transverse C-shaped member below the lock bar. The C-shaped member is adapted to engage the drive shaft housing of an outboard motor. The lock bar can releasably engage and can be locked to an upright at the free end of the pivot arm to hold the motor in place. When it is desired to remove the motor the cradle is unlocked and the arm is pivoted so that it and preferably the motor extend rearwardly from the rear opening of the truck for easy removal from the cradle. The cradle is simple, effective and durable.

6 Claims, 2 Drawing Figures

SECURITY SAFETY CRADLE

BACKGROUND OF THE INVENTION

1. Field of the Invention

The present invention generally relates to storage means and more particularly to a security safety cradle for an outboard motor or the like.

2. Prior Art

When it is desired to haul an outboard motor to a site for use, it is generally merely lifted and placed in the bed of a truck or the like. Because such motors are relatively heavy, they are relatively difficult to place in the truck bed and, if slid in place, may be damaged and scar the truck bed. During transport they also have a tendency to roll around and can suffer damage. If a brace or support is placed in the truck to hold the motor in place, the motor is still difficult to maneuver into a position in which the brace can be used. Removal of the motor from the truck presents the problem of releasing the brace, if any, and dragging the motor out of the truck bed. If the motor is, instead, crated before it is put in the truck, the crate will add considerably to the overall weight, which makes insertion into and removal thereof from the truck bed very difficult.

There is also the problem of storage of an outboard motor over, for example, the winter months, when the motor is not in use. The motor is bulky and heavy and therefore difficult to place into and remove from storage. There is a further problem of theft of the motor while in storage or during transportation to the use site.

There remains a need for an improved, light weight, inexpensive device which can be used to conveniently and safely store an outboard motor, which prevents theft of the motor and is adaptable for use with various sizes of motors and which can be easily mounted on a truck bed or the like to permit easy and safe transportation of the motor without damage thereto and to the truck bed. The device should preferably permit easy and convenient access to the motor at all times without heavy lifting.

SUMMARY OF THE INVENTION

The improved outboard motor security safety cradle of the present invention satisfies all the foregoing needs. The cradle is substantially as described in the Abstract above. Thus, it includes a transverse pivot brace securable at one side or its bottom to a support structure, such as a garage, truck, etc. It also includes an elongated support arm pivoted to the free end of the pivot brace. The arm has a motor-supporting side frame and preferably a motor-supporting bottom. The free end of the arm includes an upright alignable with a lock bracket positioned in front of the pivot brace.

The lock bracket includes an upright with transverse lock bar and C-shaped member facing the arm upright when the arm is in its forwardmost position. The lock bar can be locked to the arm upright to hold that portion of the drive shaft housing of an outboard motor which is adjacent the propeller in the C-shaped member to prevent movement and theft of the motor during transport and storage thereof. The cradle arm can be pivoted between the storage and access positions with the motor in place. Thus, the motor can be easily loaded in the cradle while the cradle is connected to the truck bed, and then the cradle arm can be pivoted to the storage position in the truck and locked in place. If the support arm includes a base support for the motor, the motor will pivot with the arm.

The cradle can include a top support member to prevent vertical movement of the motor head, a lock to secure the lock bar and arm upright together, and bolts or the like to anchor the cradle in place. The cradle can be made inexpensively of lightweight tubular steel or the like in various sizes and shapes. Further features of the invention are set forth in the following detailed description and accompanying drawings.

DESCRIPTION OF THE PREFERRED EMBODIMENT

Figure 1:
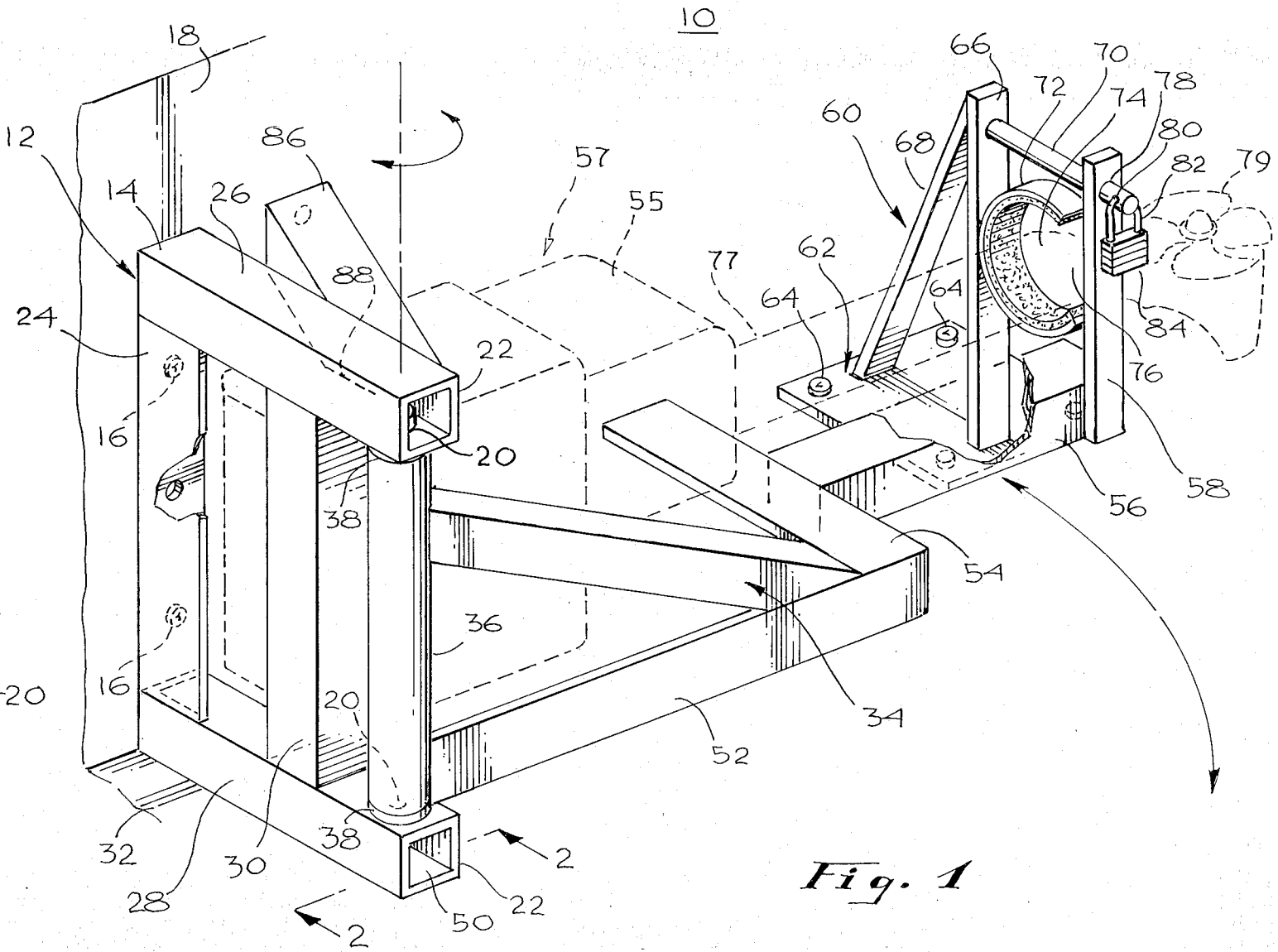
FIG. 1 is a schematic perspective view, partly broken away, showing an outboard motor in phantom outline locked in a preferred embodiment of the improved security safety cradle of the present invention; and, FIG. 2 is an enlarged fragmentary section, taken along the section line 2—2 of FIG. 1, of a pivot arm anchoring means used in the embodiment of FIG. 1.
Figure 2:
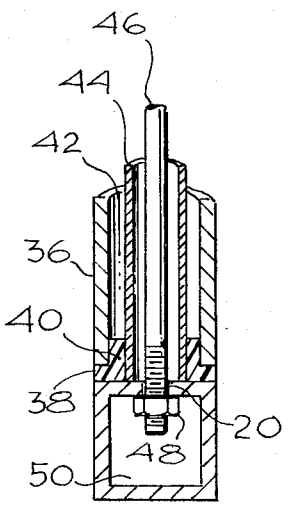

FIGS. 1 and 2

Now referring more particularly to FIGS. 1 and 2 of the accompanying drawings, a preferred embodiment of the improved security safety cradle of the present invention is schematically depicted therein. The cradle is adapted for securely holding an outboard motor for storage and transportation thereof and to prevent theft thereof.

Thus, cradle 10 is shown which comprises a transversely extending upright pivot brace 12 securable at end 14 thereof as by screws or bolts 16 to the wall 18 of a support structure such as the cargo portion of a truck, or a basement, garage, etc. Brace 12 bears a pair of aligned pivot point openings 20 (FIGS. 1 and 2) at the free end 22 thereof.

Specifically, brace 12 includes upright member 24 secured by bolts 16 to wall 18, transverse members 26 and 28 bearing pivot points 20, members 26 and 28 being connected to the upper and lower ends of member 24, and an intermediate upright member 30 also connected to members 26 and 28.

Brace 12 can be made integral or of assembled interconnected components and preferably is of hollow tubular construction, such as steel or aluminum, most preferably rectangular or square in transverse cross-section. It will be understood that, if desired, member 28 could be anchored to floor or bed 32 in place of or in addition to the anchoring of member 24 previously described.

The second major component of the improved cradle 10 of the present invention is the elongated support arm 34. Arm 34 includes an upright pivot bar 36 pivotally secured to brace 12 through openings 20. As shown in FIG. 2, bar 36 may have at each end thereof a washer 38 of nylon or the like secured thereto, as by inset collar 40 fitting within the hollow interior 42 of bar 36.

An optional, central hollow cylindrical support tube 44 may also be provided in interior 42 and a threaded bolt 46 may extend thereinto through openings 20. Bolt 46 may have nuts 48 on opposite ends to secure bar 36 to members 62 and 28. Bolt 46 can be installed in bar 36 before assembly of brace 12. Alternatively, a pair of bolts or screws (not shown) can be used, each sufficiently short so as to be installable through opening 50 in one of members 26 and 28. In that instance, washer 38 or tube 44 (if present) should be provided with a threaded opening (not shown) to receive such bolt or screw.

Arm 36 further includes a forwardly extending (in FIG. 1) frame 52 comprising a plurality of interconnected side and bottom members 54 adapted to support the head or main housing 55 of an outboard motor 57 against lateral movement. Frame 52 also includes end member 56 bearing an upright post 58 at the front end thereof.

Post 58 is alignable with a bracket 60 which comprises the third major component of the improved cradle of the present invention. Bracket 60 comprises a base plate 62 anchored, as by bolts 64, in bed or floor 32 between wall 18 and post 58, as shown in FIG. 1, and at a point directly opposite the forwardmost position of post 58. Plate 62 has secured to the upper surface thereof an upright member 66 supported by an angled brace member 68 and bearing a transverse lock bar 70 and a C-shaped member 72 below bar 70. Member 72 has a central opening 74 and a side opening 76 dimensioned to receive the drive shaft housing 77 of motor 57 near the propeller 79 thereof.

Post 58 has an opening 78 in the upper end thereof aligned with and adapted to receive bar 70, as shown in FIG. 1, when post 58 is adjacent opening 76 and thus prevents removal of housing 77 therefrom. Bar 70 has an opening 80 through which the loop 82 of a lock 84 can be fed to lock cradle 10 against removal of motor 57 from cradle 10.

Cradle 10 can also be provided with a top support member 86 securable as by bolts (not shown) to wall 18 in front of brace 15 to prevent vertical movement of housing 55 in cradle 10. As shown in FIG. 1, member 86 may be angled down and have a flat lower surface 88.

It will be understood that cradle 10 can be easily installed in the bed of a truck or in a garage, home, etc. and functions effectively to protect motor 57 during storage against damage and theft. Cradle 10 also enables motor 57 to be easily transported without theft or damage and moved in and out of cradle 10 with ease.

If desired, cradle 10 can be made without any direct connection between arm 34 and the motor-supporting bottom of the cradle, if any is present. In such event, motor 57 will not pivot along with arm 34 between the locked stored position of FIG. 1 and the rear open access position. However, motor 57 will still be movable into and out of cradle 10 when the latter is in the open access position.

Various other modifications, changes, alterations and additions can be made in the improved security safety cradle of the present invention, its components and their parameters. All such changes, modifications, alterations and additions as are within the scope of the appended claims form part of the present invention.

What is claimed is:

1. An improved security safety cradle for outboard motors and the like, said cradle comprising, in combination:

a. a transversely extending upright pivot brace securable at one end thereof to a support structure and bearing pivot points adjacent the opposite end thereof, said pivot brace comprising an upright member and a pair of transverse members secured to opposite ends of said upright member, said transverse members bearing aligned pivot points at their free ends;

b. an elongated support arm having a motor-securing portion, said support arm comprising an upright front pivot bar, a side support member connected to said pivot bar, a bottom portion connected to said side support member, and an upright post secured to the end of said arm which is remote from said pivot bar, said arm being pivotally secured to said pivot brace by said pivot bar at said pivot points and rotatable around said pivot brace between a forward secured position and a rearward release position;

c. a stop and lock bracket securable to a support structure in front of said pivot brace and engageable with said pivot arm at about the forwardmost position on said pivot arm, for releasable securing of an outboard motor enclosed by said pivot arm, said bracket comprising an upright member, a transverse bar connected at one end thereof to said upright member and a transverse C-shaped member connected to said upright member below said transverse bar, said C-shaped member having an opening adapted to receive the drive shaft of an outboard motor, said transverse bar extending through an opening in said upright post of said support arm when said support arm is in its forwardmost position, said upright post being alignable with said bracket; and, d. means for securing said brace and bracket to a support structure.

2. The improved safety cradle of claim 1 wherein said transverse bar has a lock-receiving opening at the free end thereof lateral of said upright post and wherein a lock releasably extends through said transverse bar opening to releasably lock an outboard motor in said cradle when said upright post is adjacent said opening in said C-shaped member.

3. The improved safety cradle of claim 2 wherein said cradle includes a transversely extending top support member adapted to be secured to a support structure forward of said pivot brace to hold the head of an outboard motor mounted in said cradle against vertical movement.

4. The improved safety cradle of claim 3 wherein said top support member slopes downwardly and has a horizontal bottom surface.

5. The improved safety cradle of claim 2 wherein said cradle comprises steel and is adapted to be secured to a side wall and the flat bed of a vehicle.

6. The improved safety cradle of claim 5 wherein said pivot brace is adapted to be secured to the sidewall of a truck body, wherein said bracket is adapted to be secured to the bed of a truck and includes a horizontal base, and a diagonal support connected to said base and said bracket upright.

* * * * *